United States Patent [19]

Guretzky

[11] 4,259,673

[45] Mar. 31, 1981

[54] STUB MATCHED ANTENNA AND METHOD OF FEEDING SAME

[76] Inventor: Harold Guretzky, 56-05 Clearview Exp., Bayside, N.Y. 11364

[21] Appl. No.: 45,640

[22] Filed: Jun. 5, 1979

[51] Int. Cl.[3] ..... H01Q 9/18; H01Q 9/24

[52] U.S. Cl. ..... 343/825; 343/856; 343/864

[58] Field of Search ..... 343/741, 745, 748, 856, 343/857, 861, 900, 901, 820, 821, 822, 825, 864

[56] References Cited

U.S. PATENT DOCUMENTS

| | | | |
|---|---|---|---|
| 1,831,921 | 11/1931 | Martin | 343/856 |
| 2,124,424 | 7/1938 | Leeds | 343/825 |
| 2,334,279 | 11/1943 | Neiman | 343/874 |
| 2,866,197 | 12/1958 | Kandoian | 343/723 |

OTHER PUBLICATIONS

FM & Repeaters; American Radio Relay League, Inc., (Second Edition, 1978), pp. 70 & 71.

*Primary Examiner*—Eli Lieberman

*Attorney, Agent, or Firm*—Howard A. Taishoff

[57] ABSTRACT

An antenna having a unique method of feed is comprised of a vertical radiator and a driven element. The driven element is defined by an integral, substantially straight part. RF energy is fed into or extracted from the antenna by a coil perimetrically wound around the straight part of the driven element. Preferably, this coil is comprised of the exposed, insulated inner conductor of a coaxial cable. The coil covers a relatively large segment along the periphery of the driven element giving rise to unique electrical properties. With this method of feed, the antenna exhibits good bandwidth and requires no metal-to-metal contact between feedline and antenna.

20 Claims, 10 Drawing Figures

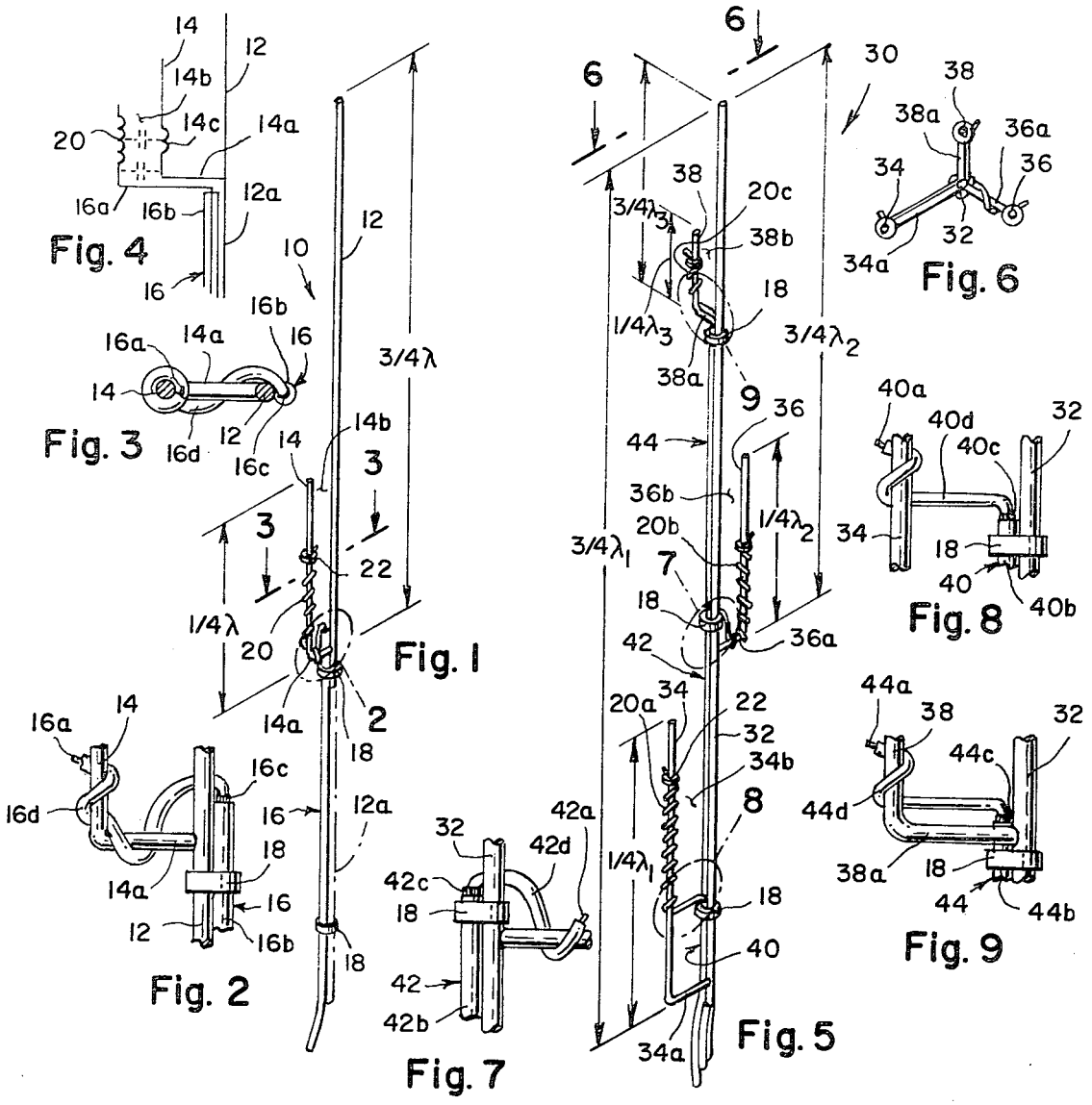
Fig. 1
Fig. 2
Fig. 3
Fig. 4
Fig. 5
Fig. 6
Fig. 7
Fig. 8
Fig. 9
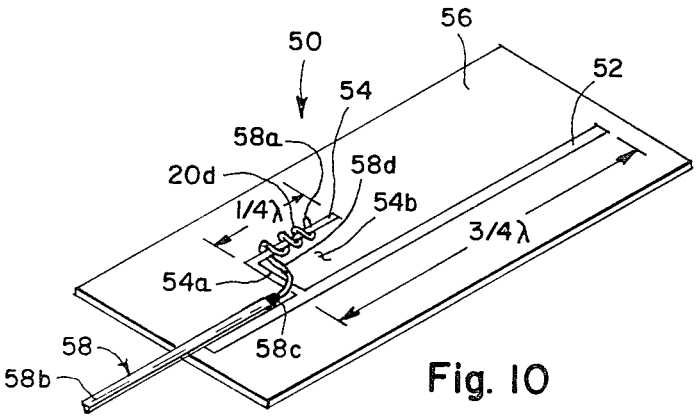
Fig. 10

STUB MATCHED ANTENNA AND METHOD OF FEEDING SAME

This invention relates to an antenna and, more particularly, to a broadbanded antenna of the J-configuration having a unique method of feed.

There are a myriad of antenna configurations available. These antennas range from simple whips and half-wave dipoles to complicated helical designs, parasitic arrays, and parabolic reflectors, to name a few. Generally, the design of a given antenna is a trade-off between electrical parameters. For example, in the case of whip antennas, their size and portability is generally comprimised by their poor radiation efficiency, narrow bandwidth, and need for a ground system against which they radiate best. In more complicated arrays, generally such systems are overly expensive, unduly massive and, electrically, leave room for improvement. Thus, while the Yagi-Uda array can exhibit excellent directional characteristics, it is quite demanding in the layout or spacing between elements and in the manner of feed. In the last-mentioned array, as with most antennas generally, the spacing between elements, and their length, effects such things as feedpoint impedance, standing-wave ratio (SWR), beamwidth, and front-to-back ratio.

Then, too, for antennna systems in the VHF range and higher, a properly matched line (line impedance to antenna feedpoint impedance) is imperative because even if a perfect match is obtained, the loss in a given feedline basically is proportional to operating frequency. Thus, at 144 MHz the loss in a perfectly matched line is approximately five times what it is at 28 MHz, given the same type of line. Yet with antennas heretofore, maximizing this parameter, feedline impedance to antenna impedance, may entail degrading one or several other parameters such as gain, or broadbandedness, or both.

Further, practically all antennas heretofore require some form of metal-to-metal or ohmic contact between the feedline and driven element. In an outdoor environment this metal-to-metal junction tends to corrode, and this corrosion can lead to rectification and spurious emission.

The antenna of the present invention overcomes several significant limitations of prior antennas. In general, the present antenna is of the J-design wherein the driven element or relatively dependent arm of the J is, preferably, a quarter-wavelength long at the desired operating frequency, and the larger vertical arm or relatively supporting radiator is, preferably, three-quarters of a wavelength long at the desired operating frequency. The driven element is defined by an integral, substantially straight part or segment. A coil, preferably comprised of the exposed, insulated and jacketed center conductor of a coaxial cable, is wound closely around the straight part of the driven element. The coil, in combination with its proximity to this straight part, provides a means for exciting the antenna and gives rise to several unique electrical properties. The driven element, in conjunction with that portion of the vertical radiator that is complimentary with and adjacent to the driven element, acts as a quarter-wave matching stub. By selectively indexing or moving the coil on and relative to the quarter-wave stub section, a feedpoint impedance can be found which will match the line impedance. Once the proper match is obtained, the coil is immobilized on the quarter-wave element. Because the coil covers a relatively large segment along a portion of the quarter-wave element or quarter-wave stub section, the antenna maintains a relatively good match over a relatively wide range of frequencies. Moreover, using this antenna configuration, and as explained below, any reasonable number of quarter-wavelength driven elements can be stacked on one vertical radiator. By feeding each driven element or quarter-wave stub section independently, a multiband configuration is readily obtained. The novel method of feeding the antennas of the present invention allows separate and essentially independent tuning of each quarter-wave stub section. Antennas built according to the present invention exhibit better than unity gain and have a relatively high angle of radiation.

It is therefore an object of the present invention to provide a J-antenna of simplified design which does not need radials or a ground system for efficient operation, and that has improved efficiency when compared to whip antennas and half-wave dipoles.

It is another object of the present invention to provide a multiband antenna that allows simultaneous operation on several different bands, and that affords good isolation between respective sections of the antenna.

It is a further object of the present invention to provide an antenna that is relatively broadbanded while maintaining a low SWR, and wherein all elements are at DC ground potential thereby acting to prevent a shock hazzard to the operator and the equipment.

It is a still further object of the present invention to provide an antenna wherein the RF energy is coupled into or extracted from the antenna by means of a coil wound around a substantially straight part of the driven element such that there is no metal-to-metal contact between the driven element and feedline.

It is one more object of the present invention to provide an antenna wherein the method of feed can accommodate a wide range of feedline impedances, and wherein the characteristic impedance of the feedline can be of nominal value such as 50 or 72 ohms.

Other objects and features of the present invention will become apparent from the following detailed description considered in connection with the accompanying drawings. It is to be understood, however, that the drawings are designed for purposes of illustration only, and not as a definition of the limits of the invention for which reference should be made to the appending claims.

In the drawings, wherein the same reference numeral denotes the same element throughout the several views:

FIG. 1 is a perspective view of one embodiment of an antenna built according to the present invention having an integral support piece shown in phantom;

FIG. 2 is an enlarged view of that portion indicated as 2 in FIG. 1 to reveal in detail the novel method of feed of the present invention;

FIG. 3 is a sectional view taken along the line 3—3 of FIG. 1 and looking in the direction of the arrows;

FIG. 4 diagrammatically illustrates the circuit embodied in the structure of FIG. 1;

FIG. 5 is a perspective view of another embodiment of an antenna built according to the present invention to show how a plurality of quarter-wave stub elements, in this case three, can be stacked and fed simultaneously to cover three bands widely spaced in frequency;

FIG. 6 is a view taken along the line 6—6 of FIG. 5 and looking in the direction of the arrows;

FIGS. 7, 8 and 9 are enlarged views of respective portions of the antenna shown in FIG. 5 to reveal in detail the method of feed according to the present invention; and FIG. 10 is a perspective view of another embodiment of an antenna built according to the present invention designed to minimize losses associated with the "skin effect."

More particularly now and referring to the drawings, FIGS. 1 through 4 illustrate one embodiment of the present invention. The antenna is indicated generally by reference numeral 10, and it is in the form of a J, so to speak, comprised of an electrically conductive three-quarter wavelength, substantially straight vertical radiator 12, and an electrically conductive, substantially straight driven quarter-wave stub element or relatively dependent arm 14. Element 14 includes an integral bend portion or finger 14*a* by means of which it is electrically coupled and mechanically attached to vertical radiator 12. Thus, when radiator 12 and element 14 are comprised of either stainless steel, aluminum, or brass, integral finger 14*a* can be welded to vertical radiator 12. It will be observed that the angularity of finger 14*a* is such that when same is welded or joined to radiator 12, element 14 is spaced from radiator 12, parallel opposed thereto, and coplanar therewith. Element 14 in conjunction with the complementary and adjacently spaced portion of radiator 12 acts as a quarter-wave stub section 14*b*. Because of the electrical properties of a quarter-wave stub, section 14*b* can be used to match the impedance of the feedline to the feedpoint impedance of the antenna. As will be explained below, vertical radiator 12 can include an integral support piece 12*a* of any length, because piece 12*a* is at RF ground.

As an example now and to determine the length of stub element 14 and vertical radiator 12 at a given operating frequency, suppose operation on the two meter amateur band (144 to 148 MHz) is desired. In average cases and as a starting point, *The ARRl Antenna Handbook* (published by the American Radio Relay league, Inc.), at 226 (Thirteenth Edition, 1974) suggests that the reasonant length of a half-wave element can be determined by the formula:

$$\text{Length (inches)} = \frac{5540}{\text{Freq. (MHz)}} \quad (1)$$

Putting the center of the band, 146 MHz, into formula (1), and converting the results to centimeters, a half-wave element is determined to be 96.4 centimeters. Thus, at the desired operating frequency quarter-wave element 14 is 48.2 centimeters long, and three-quarter wavelength radiator 12 is approximately 145 centimeters long. However, in practice it is found that best results are obtained when the length of radiator 12 is 153 centimeters and the length of stub element 14 is 51 centimeters. The spacing of element 14 from radiator 12 should be one-twentieth of a wavelength or less. Satisfactory results are obtained at 146 MHz when finger 14*a* is approximately 6.3 centimeters long. And, good electrical efficiency and mechanical rigidity are obtained when element 14 and radiator 12 each have a diameter of approximately 0.48 centimeters (0.19 inch).

Feeding or coupling RF energy into the antenna is accomplished by means of a coaxial cable 16. More particularly, the exposed, insulated center conductor or shielded "hot" lead 16*a* of cable 16 perimetrically is coiled or spirally wound around a portion of driven element 14 that, given the geometry of this element, is substantially straight. This is accomplished by removing both the outer, plastic weather jacket 16*b* and outer, metallic braid 16*c* therefrom to expose inner, dialetric jacket 16*d*. One or a plurality of cable ties 18 are used to attach coaxial cable 16 to support section 12*a* as shown. Braid 16*c* should be kept from contacting any portion of radiator 12, and, for electrical balance, cable 16 should run or align generally along the longitudinal axis of support section 12*a*. Exposed inner dialectric jacket 16*d* covering "hot" lead 16*a* is then spirally wound around the lower, straight portion of stub element 14 thereby forming a close-fitting coupling coil 20. Being more specific and as will be apparent to those skilled in the art, the length of coil 20, its location on element 14, and the number of turns per centimeter will vary according to frequency, and will vary according to the respective diameters of element 14 and radiator 12. Generally, lowering the operating frequency increases the amount of coupling that is required. Increased coupling can be accomplished by either spacing closely the individual loops comprising coil 20, or extending the longitudinal length of coil 20, or both. At the frequency of interest, 146 MHz, good results are obtained by removing approximately 36 centimeters of jacket 16*b* and braid 16*c* to expose a like amount of inner, dialetric shield 16*d*. Coil 20 is then formed of 20 turns of dialetric shield 16*d* carrying "hot" lead 16*a*. The coil is wound so as to cover or extend for approximately 25 centimeters on stub element 14 giving rise to a coil density of approximately 0.8 turns per centimeter. The exact point or location of coil 20 on element 14 is determined during use and operation of the invention as will be described now.

In operation and use of the above-described embodiment, and because most transmitters and receivers are designed to be terminated in, or driven by, a 50 to 70 ohm non-reactive load, a coaxial cable such as RG-58/U or RG-59/U, having respective characteristic impedances of 50 and 72 ohms, is chosen for cable 16. One end of the cable is stripped and spirally wound around the lower substantially straight, end of element 14 as above-noted. The other end of the cable, this other end not shown, is of course coupled to the transmitter output, or receiver input, as the case may be. To match feedline 16 to the antenna, or more precisely, to locate coil 20 on and relative to element 14, a SWR bridge is inserted in coax line 16, a procedure common to those skilled in this art. RF at the desired frequency, in this case 146 MHz, is fed into feedline 16 from the transmitter end. As this is done, coil 20 is moved on and relative to stub element 14 or stub section 14*b* until a minimum reflected component or minimum SWR is observed on the meter. This matching procedure might require the addition or removal of a few turns from coil 20, in addition to the aforesaid relative shifting of the coil on stub section 14*b*. Once the best match is obtained, a cable tie 22 is tightened about the free end of shield 16*d* thus immobilizing coil 20 on element 14. In practice, and at the last-mentioned frequency, good results are obtained when the bottom or first loop of coil 20 is located approximately 7.6 centimeters from the "bottom" of element 14, or, put another way, 7.6 centimeters up from finger 14*a*.

Coil 20 acts inductively to couple RF energy from the feedline into the inductance 14*c* presented by rod-element 14. In addition, and because of the proximity of coil 20 to element 14, a capacitive component exists between the coil and the element. This capacitive component, in addition to the distributed capacitance of feedline 16, acts in conjunction with the above-mentioned inductance to provide for an efficient transfer of energy from the feedline to the antenna. Because of the electrical nature of quarter-wave stub section 14*b*, the feedpoint impedance can be made to increase from a relatively low value to a relatively high value as coil 20 moves from the aforesaid "bottom" of stub element 14 to "top" or free end of element 14. Furthermore, because coil 20 covers a relatively large section or area on stub section 14*b*, it appears that this geometry allows the RF automatically, so to speak, to seek the best match within the confines of coil 20. Hence, when compared to ohmic or metal-to-metal feeding, the present invention broadens the range of frequencies over which a good match obtains. In time and as the need arises, loading compensations can be made to the antenna easily by loosening cable tie 22 and reorienting coil 20 relative to element 14.

Referring now to FIGS. 5 through 9, there is shown another embodiment of an antenna built according to the present invention and designed for simultaneous multiband operation. The multiband antenna is indicated generally by reference numeral 30, and it includes an essentially straight three-quarter wave vertical radiator 32 to which is attached a plurality of quarter-wave elements 34, 36, and 38 as shown. Each quarter-wave element 34, 36, and 38 includes a respective integral bend portion or finger 34*a*, 36*a*, and 38*a*, by means of which the associated stub elements are attached to vertical radiator 32. The respective fingers fixedly orient the corresponding elements parallel opposed to radiator 32 and co-planar therewith. Elements 34, 36, and 38, in conjunction with opposed complementary regions of radiator 32, act as respective quarter-wave stub sections 34*b*, 36*b* and 38*b*. Each stub section is fed by respective coaxial cables 40, 42 and 44. Each cable is respectively secured to radiator 32 by an associated cable tie 18 in a manner similar to that described with reference to FIG. 1.

In plan view, or when looking at FIG. 6, stub elements 34, 36, and 38 are shown approximately 120° apart or angulated relative to the axis provided by radiator 32. The relative angularity or placement of the stub elements is illustrative only, and to a degree, a matter of choice. However, it will be apparent that there is some electrical interaction associated with the angular orientation of the stub elements.

From formula (1) above, a length equal to three-quarters of a wavelength at the lowest operating frequency, $f_1$, is determined. Radiator 32 is then cut to at least this length generally. At frequency $f_1$, the length of a quarter-wave element is determined and stub element 34 cut to approximately this length. Support finger 34*a* is cut to a length equal to or less than one-twentieth of a wave at $f_1$, and attached to radiator 32 thereby orienting stub element 34 this same amount parallel opposed to radiator 32 and spaced therefrom. The next highest frequency, $f_2$, is chosen, and from formula (1) above, a length of equal to three-quarters of a wavelength at $f_2$ is determined. At frequency $f_2$, the length of a quarter-wave element is determined and stub element 36 cut to approximately this length. Stub 36 is then attached to radiator 32 by means of finger 36*a* at a point equal to three-quarters of a wavelength from the top of radiator 32 as shown. In practice, and as discussed below, it has been found that the length of a respective support finger, in this case finger 36*a*, should be scaled proportionately relative to frequency, and an example discussed below will illustrate this. The highest operating frequency, $f_3$, is now selected and using the above procedure, the size and location of quarter-wave stub element 38 on radiator 32 is determined. In accordance with the aforementioned scaling, finger 38*a* is cut to its respective length which is, at the frequency of interest, proportional to the length of fingers 34*a* and 36*a*.

By way of a specific example, and as an illustration only, assume that a multiband antenna for the amateur bands of 144, 220 and 432 MHz is required. Using the above procedure, efficient results are obtained when the length of vertical radiator 32 is 153 centimeters, and the respective lengths of quarter-wave stub elements 34, 36, and 38 are 51 centimeters, 30 centimeters, and 15 centimeters. Fingers 34*a*, 36*a* and 38*a* are respectively cut to 6.3, 4.5, and 2.5 centimeters, and correspondingly attached to radiator 32 at respective three-quarter wave points from the top of radiator 32 as shown. In practice however, efficient results are obtained when fingers 36*a* and 38*a* place the "bottom" or "cold" end of their respective elements at a distance of 92 centimeters and 46 centimeters from the top of radiator 32.

On end of each coaxial cable 40, 42 and 44 is prepared substantially as noted with respect to FIG. 1. More specifically, and in connection with the multiband array under discussion, approximately 36 centimeters of outer jacket 40*b* and braid 40*c* are removed from cable 40. Approximately 23 centimeters of outer jacket 42*b* and braid 42*c* are removed from cable 42, and approximately 13 centimeters of outer jacket 44*b* and braid 44*c* are removed from cable 44. As was noted in connection with FIG. 1, respective inner dielectric jackets 40*d*, 42*d*, and 44*d* covering corresponding "hot" leads 40*a*, 42*a*, and 44*a* are coiled closely around associated quarter-wave stub elements 34, 36, and 38 forming respective feed coils 20*a*, 20*b*, and 20*c*. Being more specific, efficient results are obtained when feed coils 20*a*, 20*b*, and 20*c* are wound in such manner as respectively to comprise 20 turns, 13 turns, and 8 turns of associated insulated "hot" lead leads 40*a*, 42*a*, and 44*a*, with corresponding lengths of feed coils 20*a*, 20*b*, and 20*c* extending or covering 25 centimeters, 13 centimeters, and 5 centimeters along a respective driven element.

Use and operation of the embodiment of FIG. 5 is substantially similar to that described with reference to FIG. 1. Hence, a SWR bridge is inserted in a respective feedline 40, 42, and 44, and an associated feed coil, 20*a*, 20*b*, and 20*c*, is moved relative to and on a given stub section 34*b*, 36*b*, and 38*b* until an optimum match is obtained. Once a respective optimum location is found for a respective coil, a cable tie 22 is used to fix or immobilize the relative positions of a given coil on a corresponding stub element. In practice, good results are obtained when coil 20*a* is 7.6 centimeters up from the "bottom" or finger-end of stub element 34, coil 20*b* is 5 centimeters up from an associated "bottom" end of element 36, and, coil 20*c* is 2.5 centimeters up from an associated "bottom" end of element 38.

Turning now to FIG. 10 there is shown one more embodiment of the present invention wherein the antenna is comprised of foil. The antenna shown in FIG. 10 is indicated generally by reference numeral 50 and it is of integral or monolithic construction both electrically and mechanically. Antenna 50 includes a foil or planar radiator 52 preferably cut to a length that is substantially equal to three-quarters of a wavelength at the desired operating frequency. A planar quarter-wave stub element 54 electrically is connected to radiator 52 by means of an integral finger 54*a*. Planar stub element 54 is spaced substantially parallel opposed to radiator 52 and thus is co-planar therewith. As in earlier described embodiments, element 54, in conjunction with the opposed complementary portion of radiator 52, acts as a quarter wave stub section 54*b*. Antenna 50 is, preferably, fabricated or cut from a single sheet of foil, and as such, might be comprised of aluminum, copper, or gold foil.

A rigid dielectric backing plane or block 56 comprised of, for example, teflon or lucite, supports antenna 50 as shown. It will be apparent, however, that any insulator that exhibits good dielectric properties at RF can be used. In certain applications it may be desirable to embed antenna 50 in block 56 totally.

In accordance with formula (1) above, and as noted in detail above, the overall length of three-quarter wavelength radiator 52 and quarter-wave stub element 54 is determined. The length of finger 54*a* generally will be one-twentieth of a wavelength long or less at the desired operating frequency. Because of the relatively small size of the antenna elements in the UHF range and above, it might be desirable to use a miniature coaxial cable 58, such as RG-174/U, to feed driven stub element 54 in a manner similar to the embodiments described earlier. Thus, cable 58 is prepared by removing a given length, dependent on frequency, of outer jacket 58*b* and outer braid 58*c*. This exposes a like amount of inner dielectric 58*d* covering "hot" lead 58*a*. Jacket 58*d* and lead 58*a* are closely coiled about quarter-wave stub element 54 thereby forming feed coil 20*d* as shown.

Operation and use of the antenna of FIG. 5 is generally similar to earlier described embodiments, so this operation and use need not be discussed in detail here. Suffice it to say, however, that the number of turns of insulated lead 58*a* per centimeter, the length of the coil, and its relative location on stub element 54 or stub section 54*a* is readily optimized using a SWR bridge in accordance with procedures outlined above.

Using the planar construction shown in FIG. 10, losses due to the "skin effect" are minimized. Indeed, this planar construction lends itself to other means of fabrication such as vacuum-deposition and photoetching on appropriate dielectric material, such as silicon and the like. This planar construction is adapted to fabrication with integrated circuits, and, coil 20*d*, too, can be formed as an integrated structure thereby allowing laser triming of either the coil, or the quarter-wave stub element, or both. And, though only a single quarter-wave stub element is shown in FIG. 10, the invention is not to be so limited because a multiband approach using several stacked quarter-wavelength stub elements is possible, in a manner similar to that described with reference to FIG. 5.

While only a few embodiments of the present invention have been shown and described, it is to be understood that many changes and modifications can be made hereto without departing from the spirit and scope hereof.

What is claimed is:

1. An antenna comprising a substantially straight vertical radiator, a driven element generally a quarter of a wavelength long at the desired operating frequency and closely spaced from said radiator, said element being defined by an integral, substantially straight part, coil means feeding and driving said element, said coil means being electrically coupled to a feedline and including a coil insulated from and perimetrically wound around said straight part such that said element, in conjunction with a portion of said vertical radiator, acts as a quarter-wave stub at the desired operating frequency, said coil adapted for selective indexing on said straight part thereby to allow the matching of the feedline impedance to the antenna impedance.

2. The antenna of claim 1, said vertical radiator being substantially three-quarters of a wavelength long at the desired operating frequency, said element being aligned so as generally to be parallel opposed to said radiator and co-planar therewith, means for electrically attaching one end of said element to said radiator.

3. The antenna of claim 2, said attachment means being integral with said one end of said element and adapted fixedly to support said element spaced from said radiator.

4. The antenna of claim 3, said one end of said element being disposed on said radiator substantially three-quarters of a wavelength from an end thereof.

5. The antenna of claim 1, the feedline comprising a coaxial cable one end of which is defined by its exposed, inner shielded conductor with the same being wound so as to define said coil.

6. A multiband antenna comprising a substantially straight radiator, a plurality of substantially straight driven elements each being substantially a quarter-wave long at a given operating frequency and conductively connected to said radiator, coil means feeding and driving each of said elements, each of said coil means being electrically coupled to a respective feedline and including a coil insulated from and wound around a portion of each element such that each of said elements, in conjunction with a portion of said vertical radiator, acts as a quarter-wave stub at a respective operating frequency, each of said coils being adapted for selective indexing on a respective element thereby to permit the matching of a respective feedline to the antenna.

7. The multiband antenna of claim 6, each of said elements being disposed in stacked array on said vertical radiator and configured so as generally to be parallel opposed to said radiator and co-planar therewith.

8. The multiband antenna of claim 7, said radiator being of a length that is substantially three-quarters of a wave at the lowest operating frequency.

9. The multiband antenna of claim 8, said one end of each respective element being attached to said radiator at a point that is substantially three-quarters of a respective wavelength from one end thereof.

10. The multiband antenna of claim 9, each of said elements being attached to said radiator such that the other and free end of each of said elements generally points towards said one end of said radiator.

11. A method of coupling a transmission line to an antenna that is stub fed wherein the stub has a driven element that is defined by a substantially straight part, comprising the steps of winding a given length of the insulated hot lead of the transmission line around a portion of the straight part of the driven element thereby forming a coil or loop perimetrically disposed therearound and in close proximity thereto, moving said coil relative to the straight part of the driven element until the best match is found, and immobilizing said coil relative to the stub.

12. The method of claim 11, the transmission line being comprised of coaxial cable, said winding step being accomplished by removing the outer jacket and braid from one end of the cable thereby to expose the inner dielectric jacket, and coiling the inner dielectric jacket and hot lead helically around the straight part of the driven element.

13. An antenna comprising a radiator, a driven element defined by an integral, substantially straight part, said element generally of a length equal to a quarter-wave long at the desired operating frequency and spaced parallel opposed to said radiator and co-planar therewith, said element and a complementary portion of said radiator that is parallel opposed to said element acting as a quarter-wave stub section at the desired operating frequency, coil means for coupling RF energy into or extracting RF energy from the antenna, said coil means being electrically coupled to a feedline and including a coil insulated from and wound around said straight part of said element and in close proximity thereto, said coil adapted for selective positioning on and relative to said straight part of said element thereby to allow the matching of the feedline impedance to the antenna impedance.

14. The antenna of claim 13, said radiator being substantially three-quarters of a wavelength long at the desired operating frequency.

15. The antenna of claim 14, means for fixedly supporting said element on said radiator.

16. The antenna of claim 14, means for immobilizing said coil on said straight part of said element.

17. The antenna of claim 16, said immobilizing means including a cable tie.

18. The antenna of claim 17, the feedline comprising a coaxial cable, said coil being defined by a given length of the exposed insulated center conductor of the coaxial cable.

19. A multiband antenna comprising a radiator having a length equal to approximately three-quarters of a wave at the lowest operating frequency, a plurality of stub elements each being generally of a length equal to a quarter-wave at a respective operating frequency and disposed in stacked configuration parallel opposed to said radiator, said elements and respective parallel opposed complimentary portions of said radiator operating as a respective quarter-wave stub section at a respective operating frequency, means for coupling RF energy into or out of each of said elements, said coupling means being electrically coupled to a respective feedline and including a respective coil wound around a portion of the periphery of each of said elements and in close proximity thereto, each of said coils adapted for selective indexing on a respective one of said elements thereby allowing the matching of a given feedline impedance to the antenna impedance.

20. The multiband antenna of claim 19, each of said elements including means for fixedly maintaining the parallel opposed orientation of a respective element relative to said radiator.

* * * * *

UNITED STATES PATENT AND TRADEMARK OFFICE

CERTIFICATE OF CORRECTION

PATENT NO. : 4,259,673

DATED : March 31, 1981

INVENTOR(S) : Harold Guretzky

It is certified that error appears in the above-identified patent and that said Letters Patent are hereby corrected as shown below:

Col. 7, line 34, "5" should read -- 10 --.

Col. 8, line 47 (claim 9), "said" should be deleted.

Signed and Sealed this

*Twenty-first* Day of *July 1981*

[SEAL]

*Attest:*

GERALD J. MOSSINGHOFF

*Attesting Officer*

*Commissioner of Patents and Trademarks*